US008712084B2

(12) United States Patent
Mocking et al.

(10) Patent No.: US 8,712,084 B2
(45) Date of Patent: Apr. 29, 2014

(54) MOTOR ASSEMBLY

(75) Inventors: Dennis Jacobus Mattheus Mocking, Utrecht (NL); Sietse Jacob van Reeuwijk, Soest (NL); Adrianus Maria Lafort, Delft (NL); Jeroen Leonardus Carolus de Vroomen, Lisse (NL)

(73) Assignee: Sonion Nederland BV, Hoofddorp (NL)

( * ) Notice: Subject to any disclaimer, the term of this patent is extended or adjusted under 35 U.S.C. 154(b) by 15 days.

(21) Appl. No.: 13/312,504

(22) Filed: Dec. 6, 2011

(65) Prior Publication Data

US 2012/0140966 A1 Jun. 7, 2012

Related U.S. Application Data

(60) Provisional application No. 61/420,438, filed on Dec. 7, 2010.

(51) Int. Cl.
*H04R 25/00* (2006.01)

(52) U.S. Cl.
USPC ..... 381/322; 381/324; 381/182

(58) Field of Classification Search
USPC ..... 381/322, 324, 396, 398, 421, 423–424, 381/431, 182
See application file for complete search history.

(56) References Cited

U.S. PATENT DOCUMENTS

| | | | | |
|---|---|---|---|---|
| 5,193,116 | A | 3/1993 | Mostardo | 381/69 |
| 5,757,947 | A | 5/1998 | van Halteren et al. | 381/200 |
| 5,809,158 | A | 9/1998 | van Halteren et al. | 381/200 |
| 5,920,090 | A | 7/1999 | Stenberg | 257/252 |
| 6,012,021 | A | 1/2000 | Rombach et al. | 702/150 |
| 6,075,870 | A | 6/2000 | Geschiere et al. | 381/417 |
| 6,078,677 | A | 6/2000 | Dolleman et al. | 381/418 |
| 7,062,063 | B2 | 6/2006 | Hansen et al. | 381/421 |
| 7,088,839 | B2 | 8/2006 | Geschiere et al. | 381/368 |
| 7,181,035 | B2 | 2/2007 | van Halteren et al. | 381/322 |
| 7,190,803 | B2 | 3/2007 | van Halteren et al. | 381/398 |
| 7,206,428 | B2 | 4/2007 | Geschiere et al. | 381/368 |
| 7,227,968 | B2 | 6/2007 | van Halteren et al. | 381/328 |
| 7,254,248 | B2 | 8/2007 | Johannsen et al. | 381/409 |
| 7,292,700 | B1 | 11/2007 | Engbert et al. | 381/324 |
| 7,376,240 | B2 | 5/2008 | Hansen et al. | 381/421 |
| 7,492,919 | B2 | 2/2009 | Engbert et al. | 381/418 |
| 7,657,048 | B2 | 2/2010 | van Halteren et al. | 381/322 |
| 7,706,561 | B2 | 4/2010 | Wilmink et al. | 381/398 |
| 7,728,237 | B2 | 6/2010 | Pedersen et al. | 200/11 R |
| 7,809,151 | B2 | 10/2010 | van Halteren et al. | 381/355 |
| 7,822,218 | B2 | 10/2010 | van Halteren | 381/324 |
| 7,899,203 | B2 | 3/2011 | van Halteren et al. | 381/418 |
| 7,912,240 | B2 | 3/2011 | Madaffari et al. | 381/420 |
| 7,970,161 | B2 | 6/2011 | van Halteren | 381/398 |
| 8,098,854 | B2 | 1/2012 | van Halteren et al. | 381/182 |

(Continued)

FOREIGN PATENT DOCUMENTS

| | | | |
|---|---|---|---|
| EP | 1 353 531 A2 | 4/2003 | H04R 25/00 |

OTHER PUBLICATIONS

Search Report for European Application Serial No. EP 11 19 2384 completed on Sep. 9, 2013 (2 pages).

*Primary Examiner* — Suhan Ni
(74) *Attorney, Agent, or Firm* — Nixon Peabody LLP

(57) ABSTRACT

A transducer assembly with a U-shaped element at least a part of which forms a part of a magnet housing is disclosed. One or more magnets are attached to the magnet housing which is adapted to conduct magnetic flux from one or more magnets.

20 Claims, 13 Drawing Sheets

(56) References Cited

U.S. PATENT DOCUMENTS

| | | | | |
|---|---|---|---|---|
| 8,103,039 | B2 | 1/2012 | van Halteren et al. | 381/355 |
| 8,160,290 | B2 | 4/2012 | Jorgensen et al. | 381/394 |
| 8,170,249 | B2 | 5/2012 | Halteren | 381/322 |
| 8,189,804 | B2 | 5/2012 | Hruza | 381/74 |
| 8,223,996 | B2 | 7/2012 | Beekman et al. | 381/152 |
| 8,233,652 | B2 | 7/2012 | Jorgensen et al. | 381/322 |
| 8,259,976 | B2 | 9/2012 | van Halteren | 381/328 |
| 2005/0276433 | A1 | 12/2005 | Miller et al. | 381/396 |

MOTOR ASSEMBLY

CROSS REFERENCE TO RELATED APPLICATIONS

This application claims priority to U.S. Provisional Patent Application No. 61/420,438, filed Dec. 7, 2010, and titled "A Motor Assembly," which is incorporated herein by reference in its entirety.

FIELD OF THE INVENTION

The present invention relates to a motor assembly for a hearing aid. In particular the present invention relates to a motor assembly in which a part of a U-shaped element forms part of the at least a part of a magnet housing. Moreover the present invention relates to a transducer assembly comprising a motor assembly. Finally the present invention relates to a method of forming welding magnets to a magnet housing.

SUMMARY OF THE INVENTION

In a first aspect the present invention relates to a motor assembly for a transducer assembly for a hearing aid. The motor assembly comprises a magnet housing, a U-shaped element, a coil, and one or more magnets. The U-shaped element has a secured leg portion that is secured to the magnet housing, and a movable leg portion that is adapted to be secured to a diaphragm of the transducer assembly. The magnet housing encircles the one or more magnets and the movable leg portion in a plane having a normal that extends parallel to a general direction of the movable leg portion. At least a part of the magnet housing is defined by the secured leg portion.

One advantage of providing a magnet housing at least a part of which is defined by the secured leg portion of the U-shaped element, is that a more compact construction/design may be achieved. It will be appreciated that the more compact the motor assembly is, the smaller the hearing aid may be and/or the more space is available for the remaining components of the hearing device.

In the context of the present invention, three directions are used in relation to the U-shaped elements. An X-direction corresponding to the general direction of the legs of the U-shaped element. The dimension of the U-shaped element in the X-direction is designated "the length" in the present invention. A Z-direction defining a line extending through both the legs of the U-shaped element. The dimension of the U-shaped element in the Z-direction is designated "the height" in the present invention. A Y-direction which is parallel to a normal defined by a plane defined by both the Z-direction and the X-direction. The dimension of the U-shaped element in the Y-direction is designated "the width" in the present invention. Reference is made to FIG. 5 and the corresponding part in the detailed description of the figures. The description of the directions in FIG. 5 applies to the entire document.

By utilizing a part of the U-shaped element to form a part of the magnet housing, the combined height (in the Z-direction) of the U-shaped element and the magnet housing may be reduced. Thus, the overall dimension of the motor assembly in a direction (the Z-direction) extending through both legs of the U-shaped element may be reduced. In conventional design, one leg of the U-shaped element is positioned on top of the magnet housing, thus creating at least a two layer construction, in the area of overlap. It will be appreciated that this two layer construction is eliminated by using the design of the present invention.

The transducer assembly may be adapted to transform electrical energy into sound. Typically, the transducer is adapted to transform electrical energy into mechanical energy (movement of the movable leg of the U-shaped element) which in turn creates the sound waves (by means of the diaphragm to which the movable leg portion is connected/coupled).

The transducer/motor assembly may be adapted to be fitted into any hearing aid such as a Behind-the-Ear (BTE) device, an In the Ear (ITE) device, a Receiver in the Canal (RIC) device or any other hearing aid. In the context of the present invention, the term "hearing aid" shall be understood as an electromagnetic device which is adapted to amplify and modulate sound and to output this sound inside the ear cannel of a user.

The movable leg portion of the U-shaped element is secured to the diaphragm such that movement of the movable leg portion is transferred to the diaphragm. It will be appreciated that movement of the diaphragm causes sound waves to be generated. In one embodiment, the movable leg portion is secured to the diaphragm by means of a diaphragm connecting member. The diaphragm connecting member may form a monolithic element with the U-shaped element. Alternatively, the diaphragm connecting member may by a separate element which is secured to the movable leg portion and to the diaphragm.

The diaphragm may comprise a metal material such as aluminum, nickel, stainless steel or any other material that reinforces this area.

The primary and the secondary parts which the inner space of the housing may be equally big (i.e. define substantially the same volume). Alternatively, one of the primary and the secondary parts may be bigger than the other, such as 200 percent bigger, such as 300 percent bigger, such as 400 percent bigger, such as 500 percent bigger, such as 600 percent bigger, such as 700 percent bigger, such as 800 percent bigger, such as 900 percent bigger, such as 1000 percent bigger, such as 1500 percent bigger.

The U-shaped element defines the secured leg portion which is interconnected to the movable leg portion by means of a interconnecting portion. It will be appreciated that although one of the leg portions of the U-shaped element is designated "the secured leg portion", a part of this leg portion may move during use of the device as only the area securing the secured leg portion relative to the housing is prevented from moving relative to the housing, while the remaining part of the secured leg portion may move relative to the housing. The U-shaped element may be a monolithic element or made from several parts.

In one embodiment, the interconnecting portion is curved and/or U-shaped. In one embodiment, at least one of (and perhaps both) the leg portions are substantially straight. Each of the leg portions may define a tip end which is provided in the opposite end of the respective leg portion than the interconnecting portion.

As mentioned previously, the present invention eliminates the two layer structure defined in the area of overlap of the magnet housing and the secured leg portion. The reason for this is that the secured leg portion forms a part of the magnet housing. As a consequence, the entire design may be thinner and more compact in the Z-direction. This provides the advantage that the vibrations in the device are reduced. The reduction of the vibrations can be explained in the following manner. During use, the tip of movable leg portion moves up and down (i.e., in a Z-direction). However, during use, the tip will also move forwards and backwards (i.e., in an X-direction) as the movable leg portion moves about the interconnecting portion. The amplitude of the movement in the X-direction is determined by the dimension of the interconnecting portion. If the interconnecting portion is tall the amplitude in the X-direction is large, whereas a small interconnecting portion causes the amplitude in the X-direction to be small. Thus, as the current invention allows for a shorter U-shaped element (in the Z-direction), the amplitude in the X-direction is smaller. This is highly desirable as a lower amplitude of any vibration in the device is desired by manufacturers of hearing aids.

In one embodiment, the dimensions of the U-shaped element are chosen such that the size of the force Fz of the vibrations in the Z-direction is substantially identical to the size of the force Fx of the vibrations in the X-direction. In yet another embodiment, Fz is larger than Fx, such as 20 percent larger, such as 40 percent larger, such as 50 percent larger. Alternatively, Fz is smaller than Fx, such as 20 percent smaller, such as 40 percent smaller, such as 50 percent smaller.

The height of the interconnecting element in the Z-direction may be less than four times the thickness of one of the leg portions in the Z-direction, such as less than three times the thickness, such as less than two times the thickness, such as less than one and a half times the thickness, such as less than one time the thickness.

In one embodiment, the movable leg portion is connected to the diaphragm in the area of the tip portion. By "in the area of the tip portion" may be understood that the movable leg portion is connected to the diaphragm at a point in an area covering a fifth of the length of the movable leg portion and including the tip thereof, such as a fourth of the length of the movable leg portion (and including its tip), such as a third of the length of the movable leg portion (and including its tip).

In one embodiment, the secured leg portion is secured to the housing either directly or via one or more elements. In one embodiment, the secured leg portion is glued and/or welded and/or soldered to the housing.

The coil is arranged to induce a magnetic field in the U-shaped element. In one embodiment, the coil is arranged such that the movable leg portion extends through a passage defined by the coil. The coil may define a number of windings which encircle the passage. It will be appreciated that the coil may be substituted by any other means for inducing a magnetic field in the U-shaped element.

The motor assembly may comprise one or more magnets. The magnets are preferably arranged inside the magnet housing. The magnets may be arranged close to or in direct contact with the magnet housing such that the magnet housing can conduct the magnetic flux of the magnets.

In one predetermined two-magnet embodiment, the magnets are spaced apart such that a space is defined between the two magnets. In this space, the movable leg portion may be provided. One of the magnets is arranged such that its north pole is facing the movable leg portion, while the other of the magnets is arranged such that its south pole is facing the movable leg portion. The opposite pole of each of the two magnets is provided in direct contact with or close to the magnet housing such that the magnetic flux is conducted by the magnet housing from one magnet to the other. Accordingly, inductance of a magnetic field in the movable leg portion by means of the coil causes the movable leg portion to move towards one of the two magnets depending on the polarity of the magnetic field in the movable leg portion.

In one predetermined single-magnet embodiment, the one magnet is provided close to or in direct contact with the magnet housing such that one of the poles of the magnet faces the magnet housing. The other of the poles faces a space defined between the magnet and the opposite side of the magnet housing. In this space, the movable leg portion is provided. Thus, induction of a magnetic field in the movable leg portion causes the movable leg portion to move closer to the magnet or closer to said opposite side of the magnet housing (i.e. away from the magnet).

It will be appreciated that the magnet housing may encircle the one or more magnets and the movable leg portion in a predetermined plane. This predetermined plane may define a normal which extends parallel to a general direction of the movable leg portion (i.e. in the X-direction). In other words, the plane defines a right angle with the movable leg portion.

As mentioned above, at least a part of the magnet housing is defined by the secured leg portion. In one embodiment, the magnet housing defines four sides, three of which are defined by a substantially C-shaped element and a fourth of which is defined by the secured leg portion. The four sides may define a rectangular or quadrangular cross-section e.g. in a plane defining a normal to the general direction of the movable leg portion.

In yet another embodiment, the magnet housing defines four sides. The sides or the inner surface of the sides, may define a rectangular or quadrangular cross-section in a plane which defines a normal to the general direction of the movable leg portion. At least a part of the four sides may be defined by the secured leg portion. In one embodiment, the secured leg portion additionally defines a part of one or both of the neighboring sides of the magnet housing.

In one embodiment, the magnet housing defines an inner surface at least a part of which is defined by the secured leg portion. Alternatively, or as a supplement, the magnet housing may define an outer surface at least a part of which is defined by the secured leg portion.

In one embodiment, the magnet housing defines one or more sides at least one of which defines a first part and a second part, the first part being defined by the secured leg portion and the second part being defined in the same plane as the first part. In one embodiment, "in the same plane" shall be understood such that the plane shall extend through at least a part of the first part and through at least a part of the second part.

In another embodiment, "in the same plane" shall be understood such that the outer surface (i.e. the surface extending away from that part of the movable leg portion which is provided inside the magnet housing) of at least a part of (such as all of) the first part and at least a part of (such as all of) the second part coincide with said plane.

In yet another embodiment, "in the same plane" shall be understood such that the inner surface (i.e. the surface facing that part of the movable leg portion which is provided inside the magnet housing) of at least a part of (such as all of) the first part and at least a part of (such as all of) the second part coincide with said plane.

It will be appreciated that the above interpretations of "in the same plane" are not incombinable. Thus, some embodiments of the invention may fulfill the requirements of more than one of the interpretations of "in the same plane".

Alternatively, or as a supplement, the first and the second parts are arranged such that it is not possible to define a first plane extending parallel to the general direction (the X-direction) of the first secured leg portion which extends through only one of the first and the second part. In other words, any such first plane will extend through both the first and the second part. In the latter embodiment, it may not be possible to define a second plane which is parallel to the first plane and which extends through a part of the first and/or the second part, through which the first plane does not extend.

Moreover, the magnet housing may define one or more sides at least one of which defines a first part and a second part, the first part may be defined by the first secured leg portion and the second part may form an extending of the first part in a plane defined by the secured leg portion. The second part may form an extension of the first part in the general direction of the secured leg portion, e.g. such that the second part defines an extension of the tip of the secured leg portion. Moreover, the second part may define an extension in any direction in a plane extending through the general direction of the secured leg portion. Accordingly, the second part may form an extension in a direction transverse to the general direction of the secured leg portion. As an example, the second part may form an indentation for receiving the first part.

In one embodiment, a first and a second plane extend through the magnet housing, each of the planes define a normal which extends in a direction parallel to a general direction (the X-direction) of the movable leg portion. Thus, the first plane and the second planes are parallel to each other. In the latter embodiment, the first plane may extend through both the first part and the second part of the magnet housing, while the second plane may extend through the second part only. The second plane may be closer to the tip of the secured leg portion than the first plane.

In one embodiment, said two planes also extend through the remaining parts/sides of the magnet housing.

As mentioned above, the first part may define at least one indentation adapted to receive a protrusion of the second part. Accordingly, the first part may define one indentation or two indentations or three indentations or four indentations etc. Alternatively, or as a supplement, the second part may define at least one indentation adapted to receive a protrusion of the first part. Similarly, the second part may define one indentation or two indentations or three indentations or four indentations etc. When both the first and the second part each defines one or more indentations, the two parts may define a plurality of protrusions and a plurality of indentations which are adapted to engage each other.

Furthermore, the magnet housing may form a single layer structure when seen in a radial direction from the centre of gravity of that part of the movable leg portion which is encircled by the magnet housing. In one embodiment, the single layer structure is formed when seen in a radial direction from a geometrical centre of the magnet housing.

In one embodiment, the magnet housing forms a single layer structure when seen in a radial direction from a geometrical centre of that part of the movable leg portion which is encircled by the magnet housing.

In the context of the present invention, the "geometrical centre" of one or more elements may be defined as the centre of the minimum circumcised circle and/or of the maximum inscribed circle. The minimum circumcised circle being defined as the smallest circle which encloses whole of the respective element(s). The maximum inscribed circle being defined as the largest circle that can be inscribed inside the respective element(s).

As mentioned above, the one or more magnets may comprise two magnets which are spaced apart so as to define a (three dimensional) space between the two magnets. This space may also be called a gab. The movable leg portion may be provided in this space.

Again, as mentioned previously, each of the one or more magnets may be attached to the magnet housing. At least one of the one or more magnets may be attached to the housing by means one or more of: welding, soldering and an adhesive.

In one embodiment, at least one of the one or more magnets is spaced apart from the magnet housing by means of a foil or an adhesive. In one embodiment, the magnet(s) is/are attached to the magnet housing by means of welding or by means of an adhesive.

In a second aspect, the present invention relates to a transducer assembly for a hearing aid comprising a housing, a first diaphragm, and a first motor. The first diaphragm divides a first inner space of the housing into a primary and a secondary part. The first motor assembly is arranged in accordance with any of the previous embodiments. The first motor assembly has a first movable leg portion which is secured to the first diaphragm.

In one embodiment, the transducer assembly further comprises a second diaphragm that divides a second inner space of the housing into the secondary and a tertiary part. And, a second motor assembly is provided accordance with any of the previous embodiments. The second motor assembly has a second movable leg portion that is secured to the second diaphragm.

In a third aspect, the present invention relates to a method of laser welding a magnet to a U-shaped element of a transducer assembly according to any of the preceding embodiments. The U-shaped element defines a secured leg portion and a movable leg portion. Each of the leg portions defines a first and a second opposite side. The method comprising the steps of providing the magnet on a first side of one of the leg portions of the U-shaped element, and directing a laser beam towards a welding zone of the second side of the same leg portion. The method further comprises maintaining the laser beam towards the welding zone until (i) said leg portion in the area of said welding zone has changed from a solid state to a melded state all the way through said leg portion from the second side to the first side, and (ii) at least a part of the magnet has changed from a solid state to a melted state. The method further comprises cooling the magnet and the U-shaped element such that the magnet and the U-shaped element are welded together in the area of the welding zone.

It will be appreciated that the welding zone shall be construed as not only that part of the second surface towards which the laser beam is directed but also any material below the surface, i.e. both material in the U-shaped element and material in the magnet. In one embodiment, the method further comprises forming an aperture in the area of the welding zone, wherein the aperture extends from the first side to the second side of the U-shaped element. The method further comprises subjecting, from the second side, an inner surface of the aperture and a visible zone of the magnet to a laser beam so as to cause the magnet to be welded to the U-shaped element.

It will be appreciated that the visible zone is that part of the magnet which is visible when looking through the aperture formed in the U-shaped element.

The method according to the second aspect of the invention may comprise any combination of features and elements of the invention according to the first aspect of the invention.

BRIEF DESCRIPTION OF THE FIGURES

The invention will now be described with reference to the figures in which.

Figure 1:
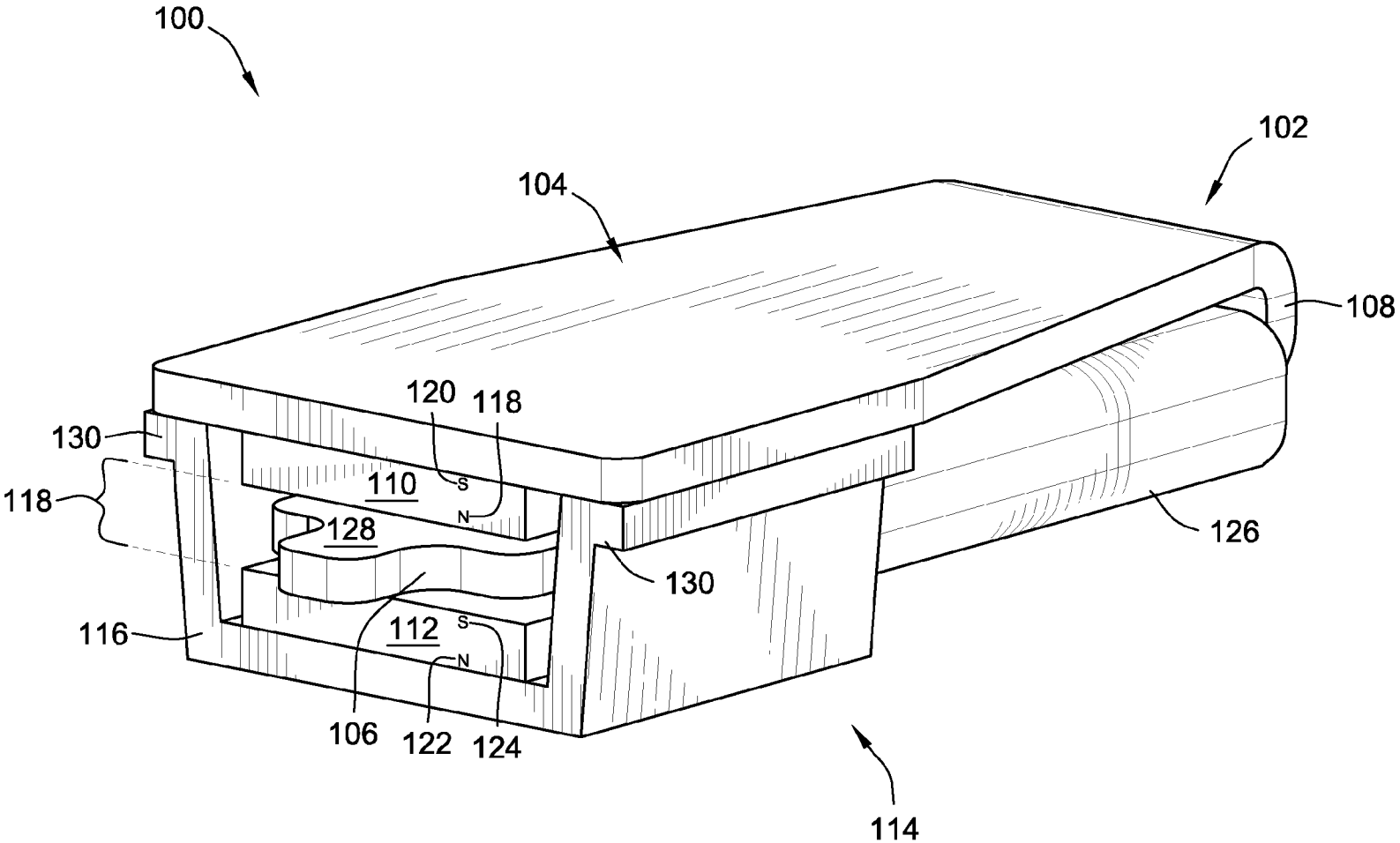
FIG. 1 discloses an isometric view of a first embodiment.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE FIGURES

Figure 2:
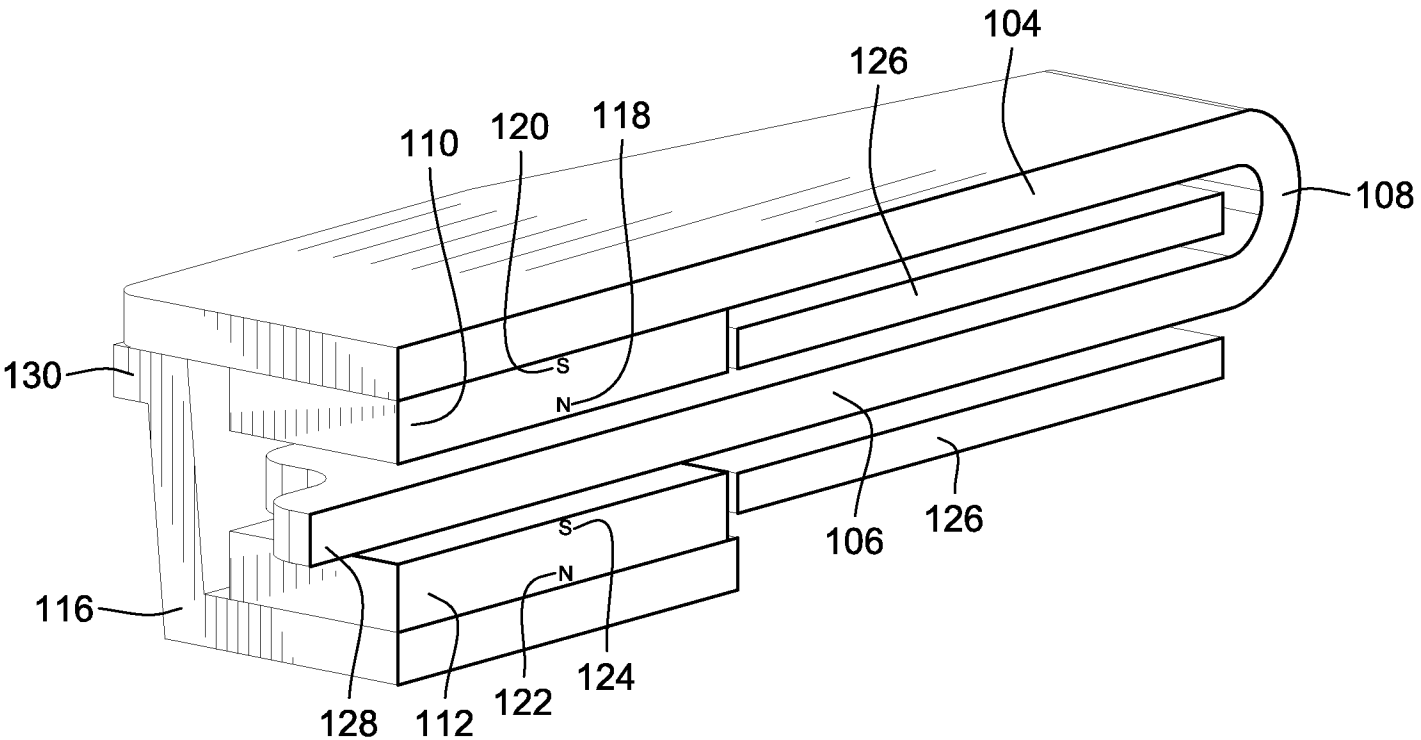
FIG. 2 discloses a cross-sectional view of the first embodiment.

FIGS. 1-2 disclose a first embodiment of a part of a transducer assembly 100 comprising a first U-shaped element 102 having a first secured leg portion 104 which is interconnected to a first movable leg portion 106 via a first interconnecting portion 108. Moreover, the transducer assembly 100 comprises a first upper magnet 110 and a first lower magnet 112 which are provided inside a first magnet housing 114. The first magnet housing 114 is defined by a part of the first secured leg portion 104 and a first C-shaped element 116. Between the upper first magnet 110 and the lower first magnet 112 are separated by a space 118 in which the first movable leg portion 106 is provided.

In the embodiment of the figure, an first upper north pole 118 of the first upper magnet 110 is facing the first movable leg portion 106 while an first upper south pole 120 of the first upper magnet 110 is facing that part of the first secured leg portion 104 which forms part of the first magnet housing 114.

Similarly, a first lower north pole 122 of the lower first magnet 112 is facing the first C-shaped element 116 of the first magnet housing 114, while a first lower south pole 124 of the lower first magnet 112 is facing first movable leg portion 106.

The first movable leg portion 106 is moved by inducing a magnetic field in the first U-shaped element 102 by means of a first coil 126. Depending on the polarity of the magnetic field in the area of the first movable tip 128 of the first movable leg portion 106, the first movable tip 128 is moved towards the first upper magnet 110 or towards the first lower magnet 112.

The first C-shaped element 116 defines a first flanges 130 by means of which the first C-shaped element 116 is secured to the first secured leg portion 104. This may be done by means of an adhesive, welding or soldering or any other fastening method.

Figure 3:
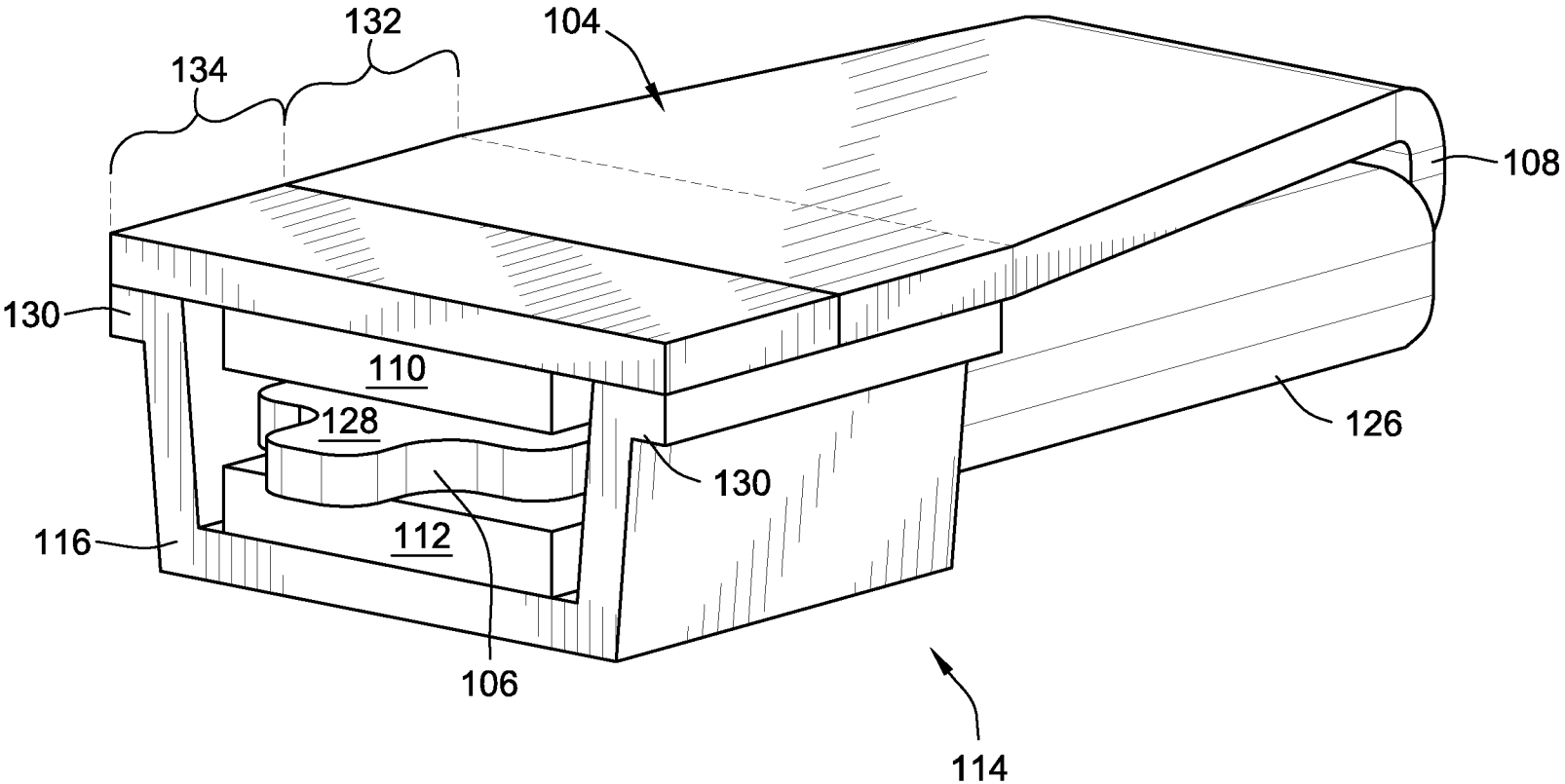
FIG. 3 discloses an isometric view of a second embodiment.

FIG. 3 discloses a second embodiment which is an alternative to the first embodiment, and thus identical reference numbers refer to identical elements. The second embodiment only differs from the first embodiment in that one side of the first magnet housing 114 comprises an upper first part 132 and an upper second part 134. The upper first part 132 is formed by a part of the first secured leg portion 104, while the upper second part 134 is a separate element which forms an extension of the upper first part 132.

Figure 4:
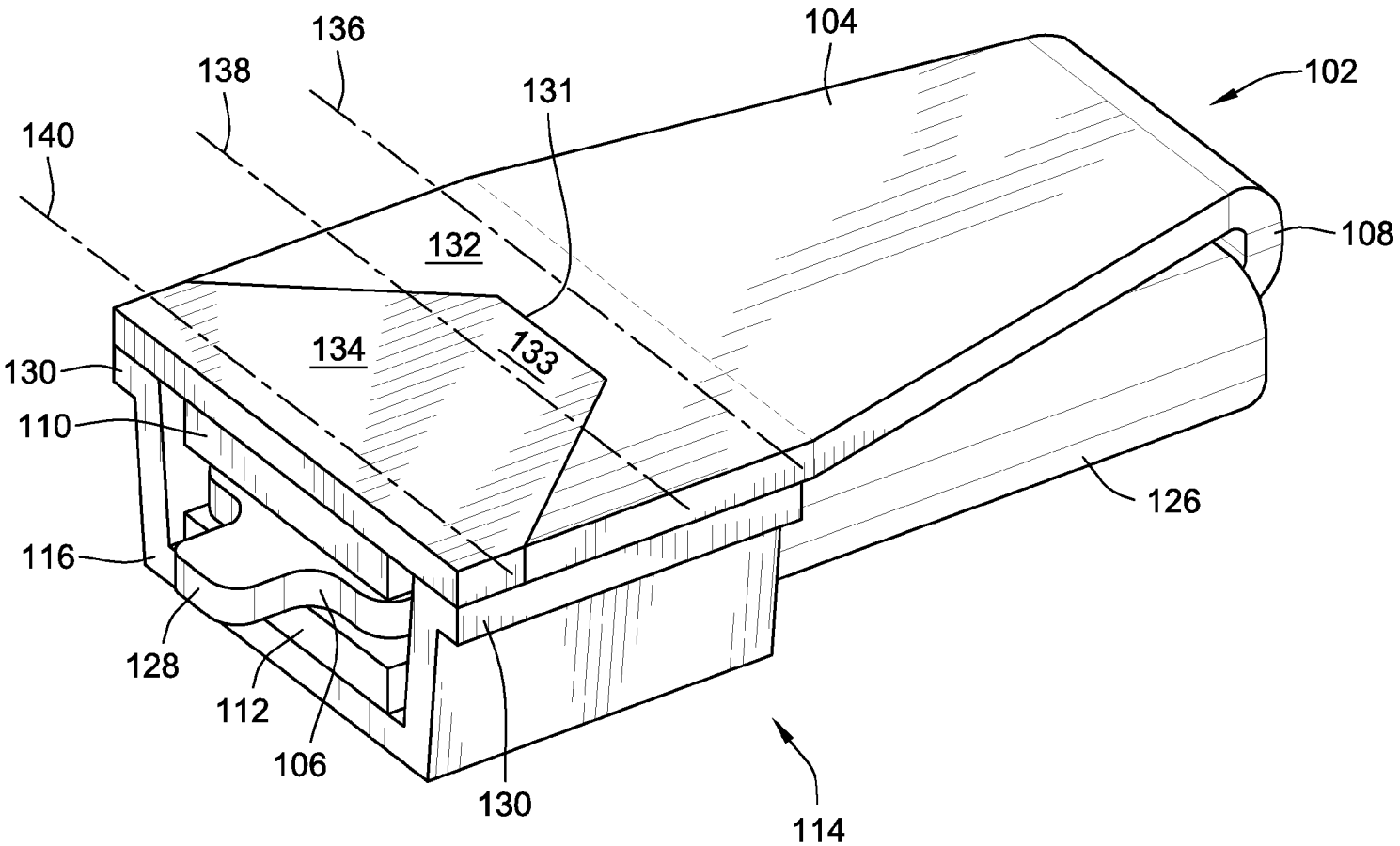
FIG. 4 discloses an isometric view of a third embodiment.

FIG. 4 discloses a third embodiment which is an alternative to the first and the second embodiment, and thus identical reference numbers refer to identical elements. In the third embodiment, the upper first part 132 defines an indentation 131 for receiving a protrusion 133 of the upper second part 134. It will be appreciated a cross-section through a line 136 will only extend through the upper first part 132, while a cross-section though a line 138 will extend through both the upper first part 132 and the upper second part 134. Similarly, a cross-section through a line 140 only extends through the upper first part 132.

Figure 5:
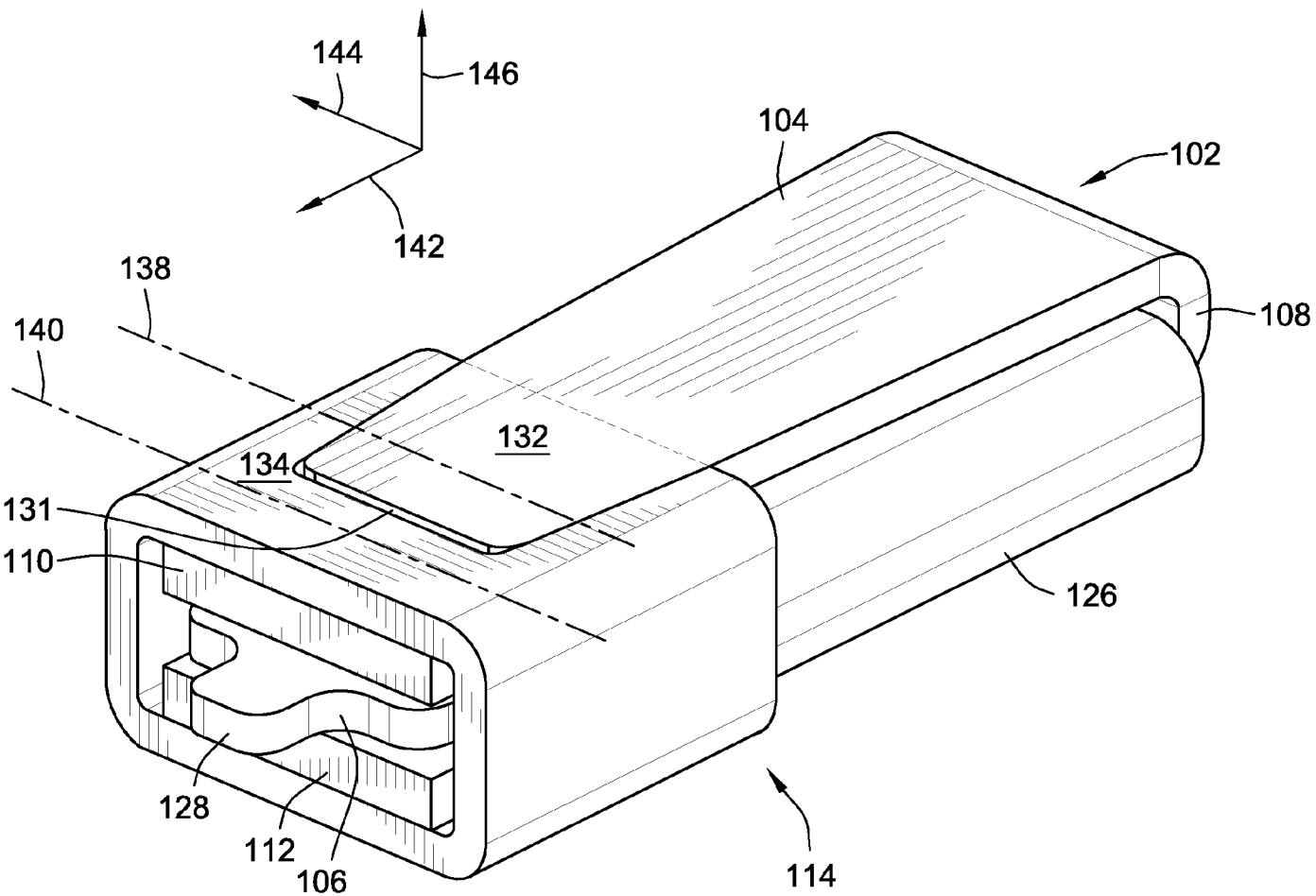
FIG. 5 discloses an isometric view of a fourth embodiment.

FIG. 5 discloses a fourth embodiment which is yet another alternative to the previous embodiments. Again, identical reference numbers refer to identical elements. In FIG. 5 the upper second part 134 defines an indentation 131 for receiving the upper first part 132. In the figure, a cross-section through the line 138 extends through both the upper first part 132 and the upper second part 134, whereas a cross-section through the line 140 extends through the upper second part 134 only. In the embodiment of FIG. 5, the upper second part 134 forms an extension of the upper first part 132 in the X-direction 142 and in the Y-direction 144. The X-direction 142 is the direction of the general direction of each of the legs 104, 106 of the first U-shaped element 102, whereas the Z-direction 146 is parallel to a line extending through and defining a normal to both legs 104,106. The Y-direction is a direction that is parallel to a normal to a plane defined by the X-direction 142 and the Z-direction 146.

FIGS. 3-5 are alternative embodiments of the design of FIG. 1. These alternatives allows for the assembly order of the elements to be different.

Figure 6:
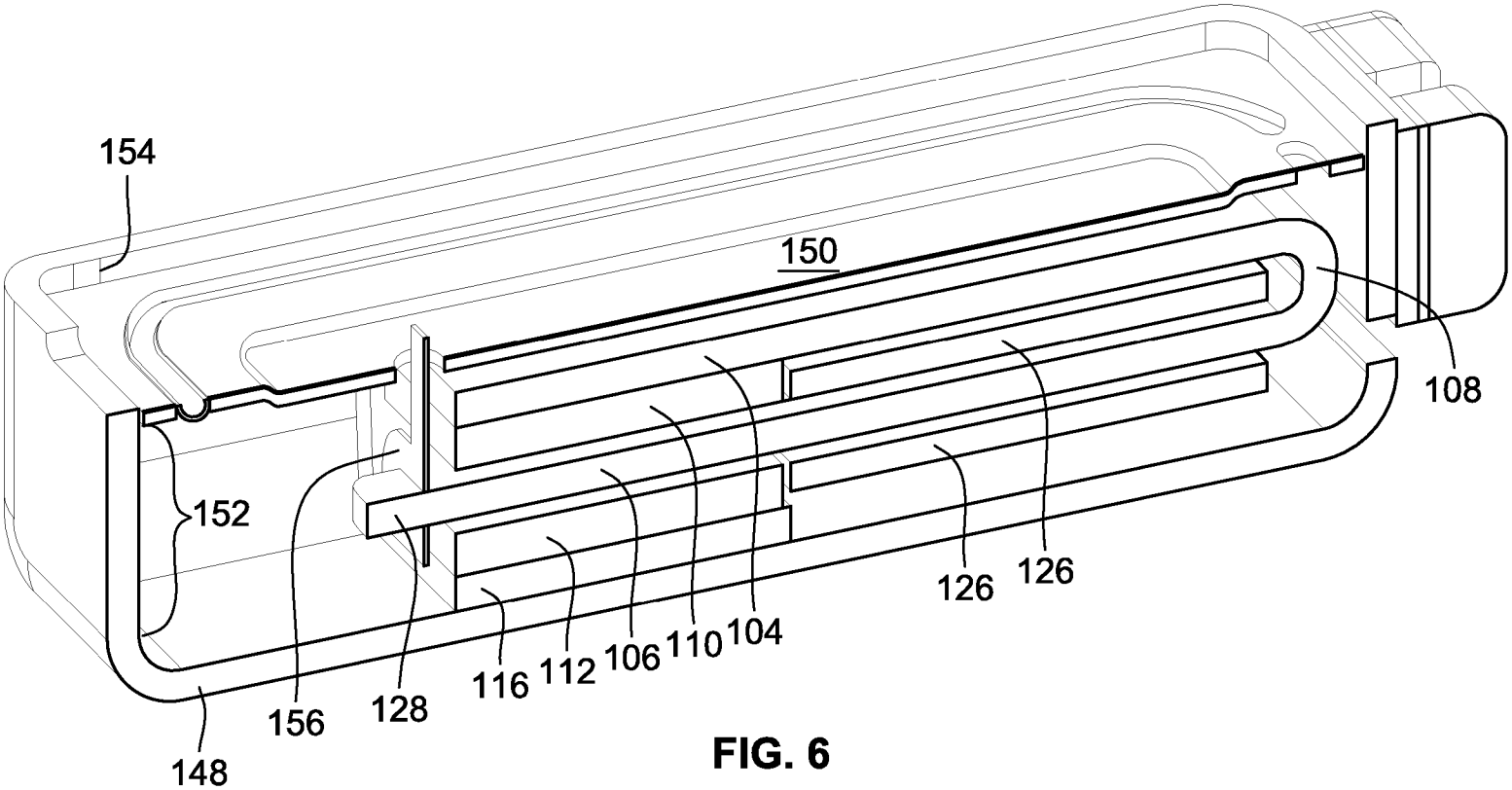
FIG. 6 discloses a cross-sectional view of the first embodiment including the housing and the diaphragm.

FIG. 6 discloses a cross sectional view of the first embodiment. Again identical reference numbers refer to identical elements. In FIG. 6, the transducer assembly 100 comprises a housing 148 comprising a first diaphragm 150. The housing 148 is divided into a primary part 152 and a secondary part 154 (only a part of which is disclosed in the drawing). The first movable leg portion 106 is secured to the first diaphragm 150 by means of a first diaphragm connecting element 156 whereby movement of the first movable leg portion 106 causes the first diaphragm 150 to move whereby sound is produced.

Figure 7:
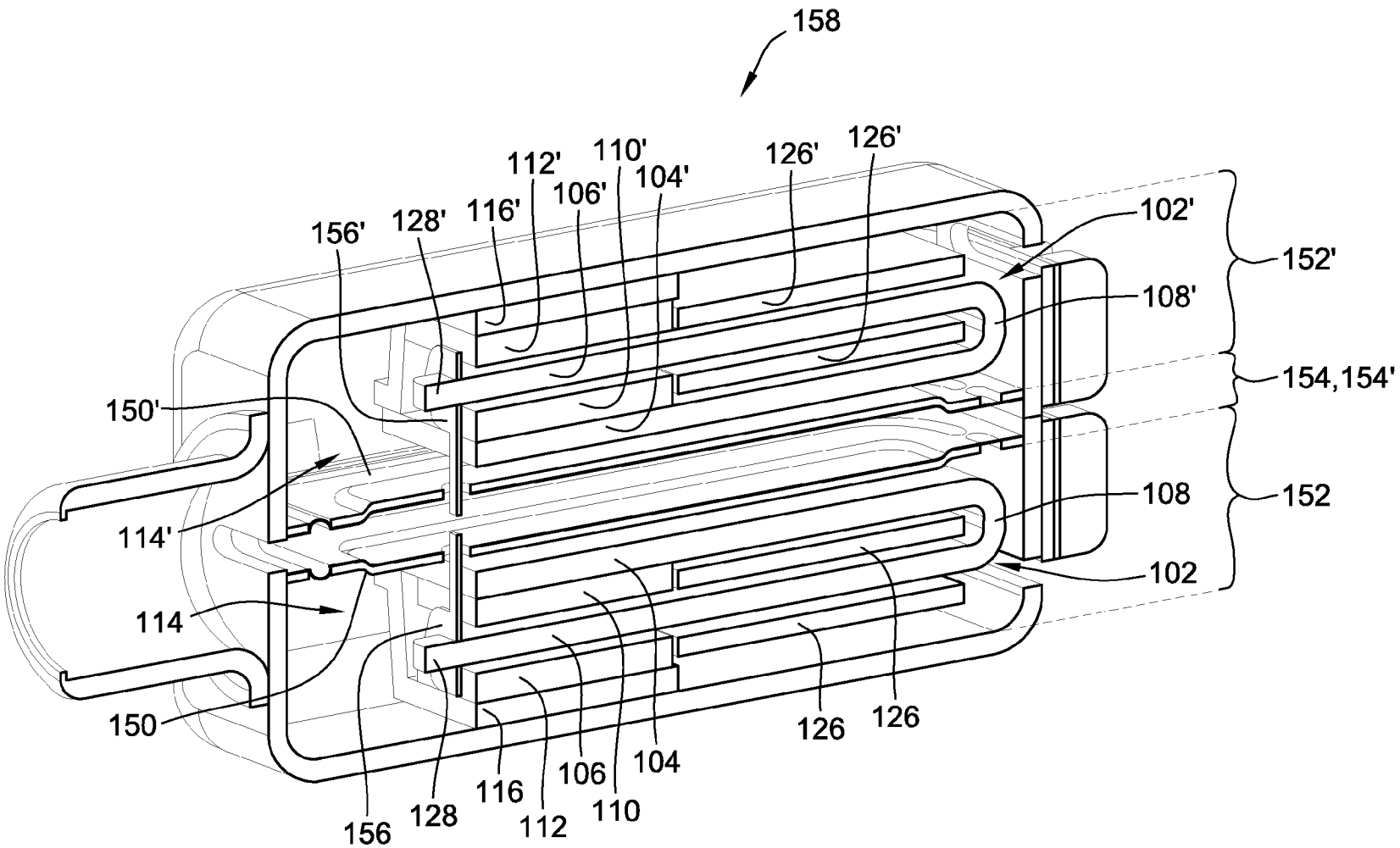
FIG. 7 discloses a cross-sectional view of a fifth embodiment.
Figure 8:
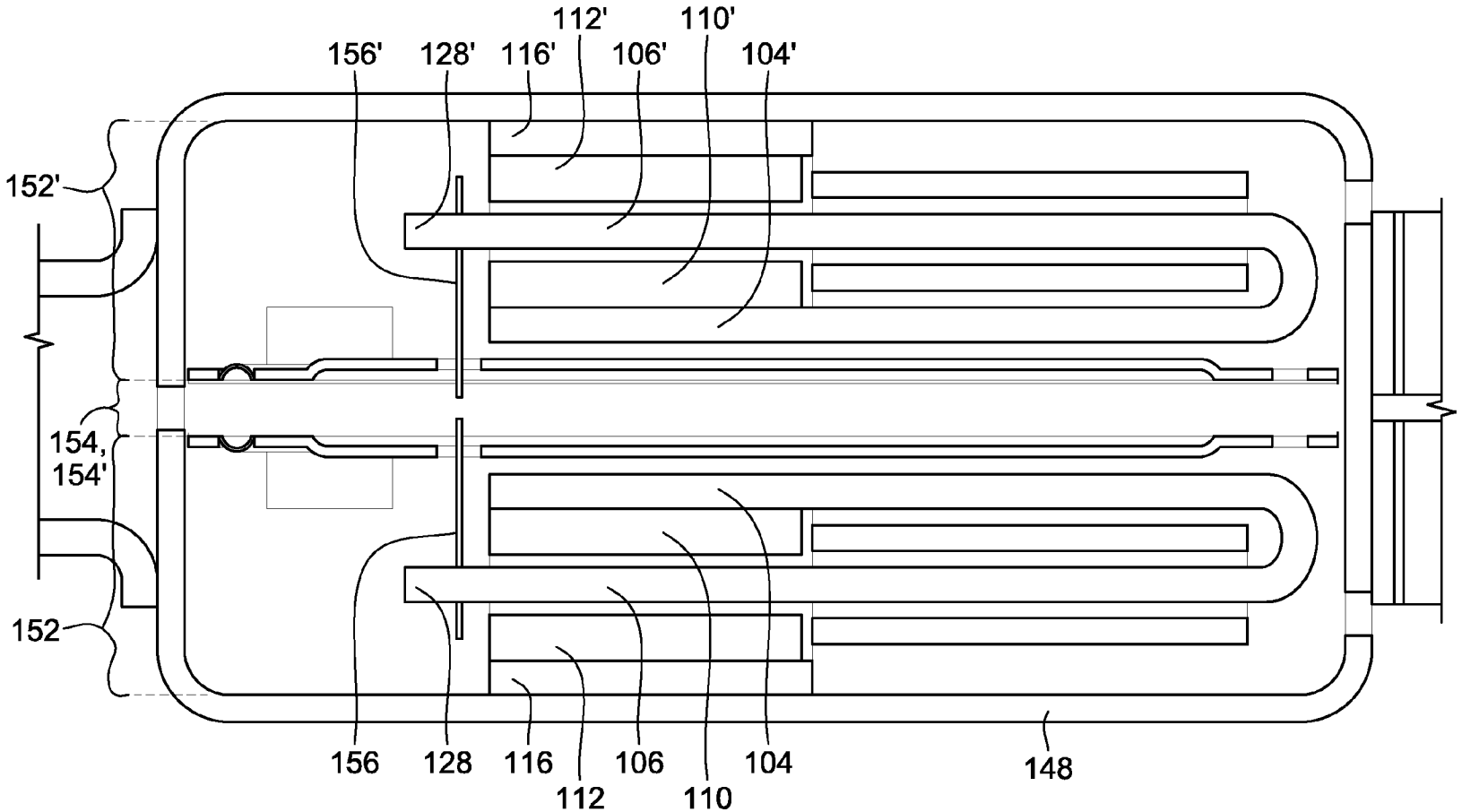
FIG. 8 discloses a cross-sectional view of the fifth embodiment.

FIGS. 7-8 disclose a dual transducer assembly 158 comprising a first U-shaped element 102 having a first secured leg portion 104 which is interconnected to a first movable leg portion 106 via a first interconnecting portion 108. Moreover, the transducer assembly 100 comprises a first upper magnet 110 and a first lower magnet 112 which are provided inside a first magnet housing 114. The first magnet housing 114 is defined by a part of the first secured leg portion 104 and a first C-shaped element 116.

Furthermore, the dual transducer assembly 158 comprises a second U-shaped element 102' having a second secured leg portion 104' which is interconnected to a second movable leg portion 106' via a second interconnecting portion 108'. Moreover, the transducer assembly 100 comprises a second upper magnet 110' and a second lower magnet 112' which are provided inside a second magnet housing 114'. The second magnet housing 114' is defined by a part of the second secured leg portion 104' and a second C-shaped element 116'.

In the embodiment of FIGS. 7-8, a primary part 152 and a secondary part 154 are defined by the space of the first transducer element. Moreover, the second transducer element defines a tertiary part 154' and a quaternary part 152'. It will be appreciated that in the embodiment of the figure, the tertiary part 154' and the secondary part 154 are form the same compartment.

Figure 9:
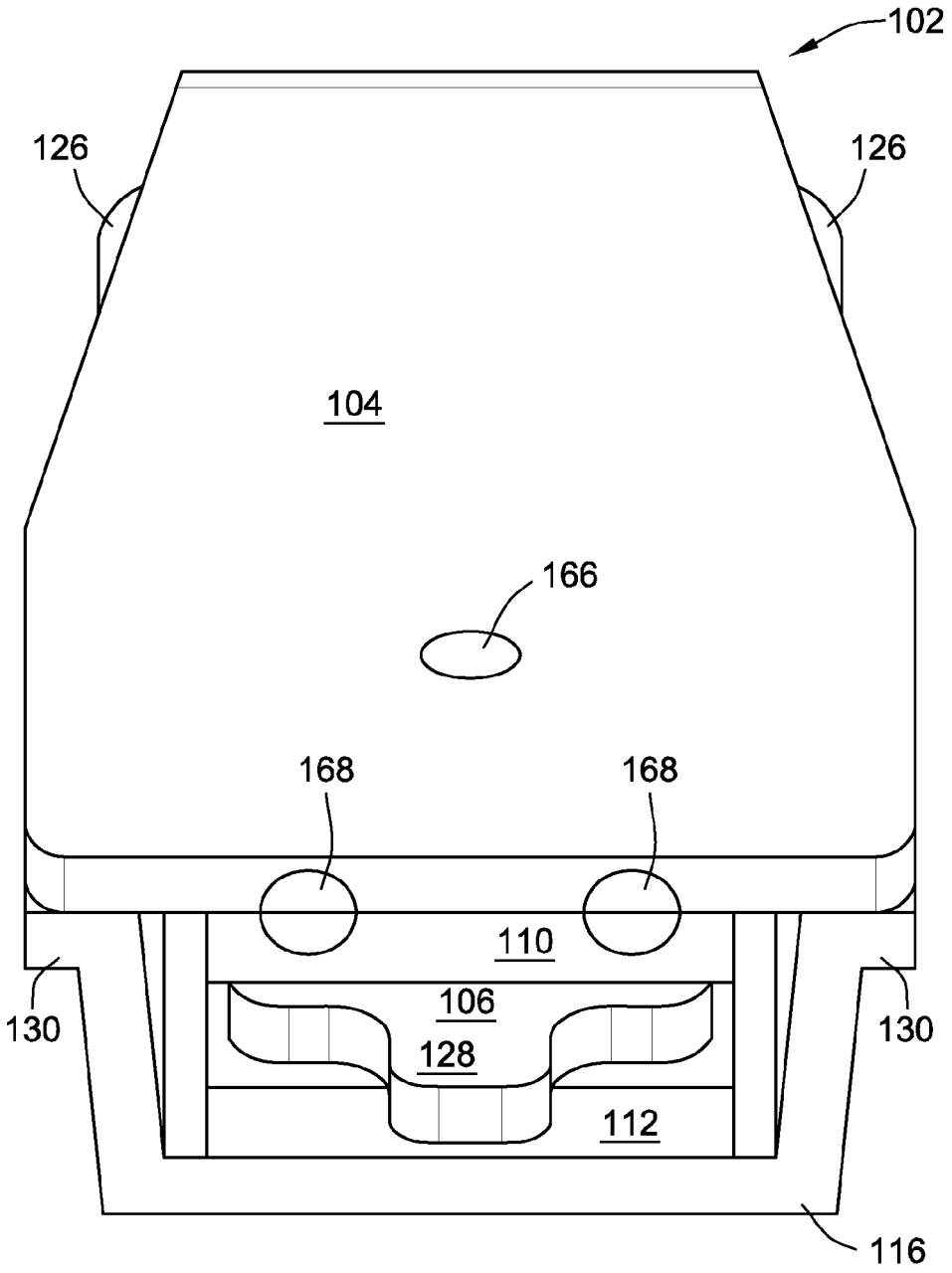
FIGS. 9-11 disclose an isometric view of the first embodiment, wherein the magnets are laser welded to the magnet housing.
Figure 10:
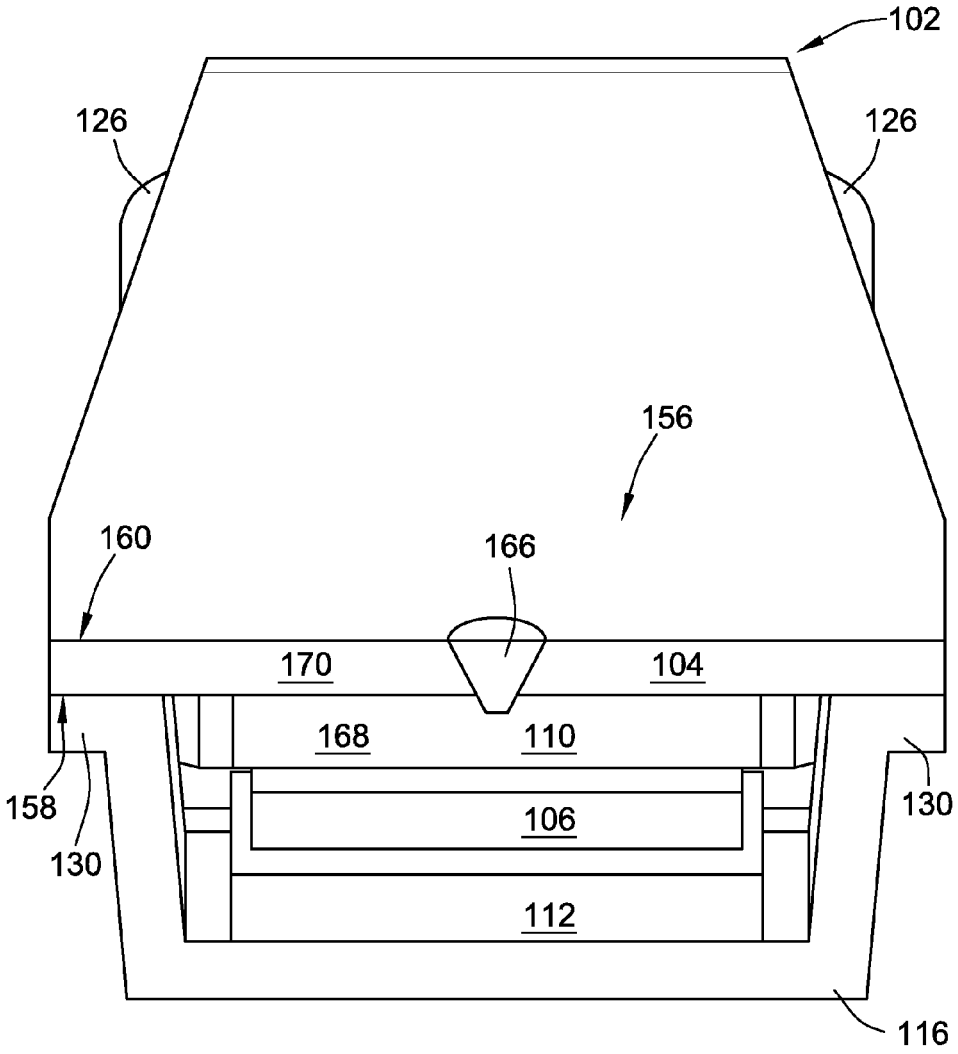
Figure 11:
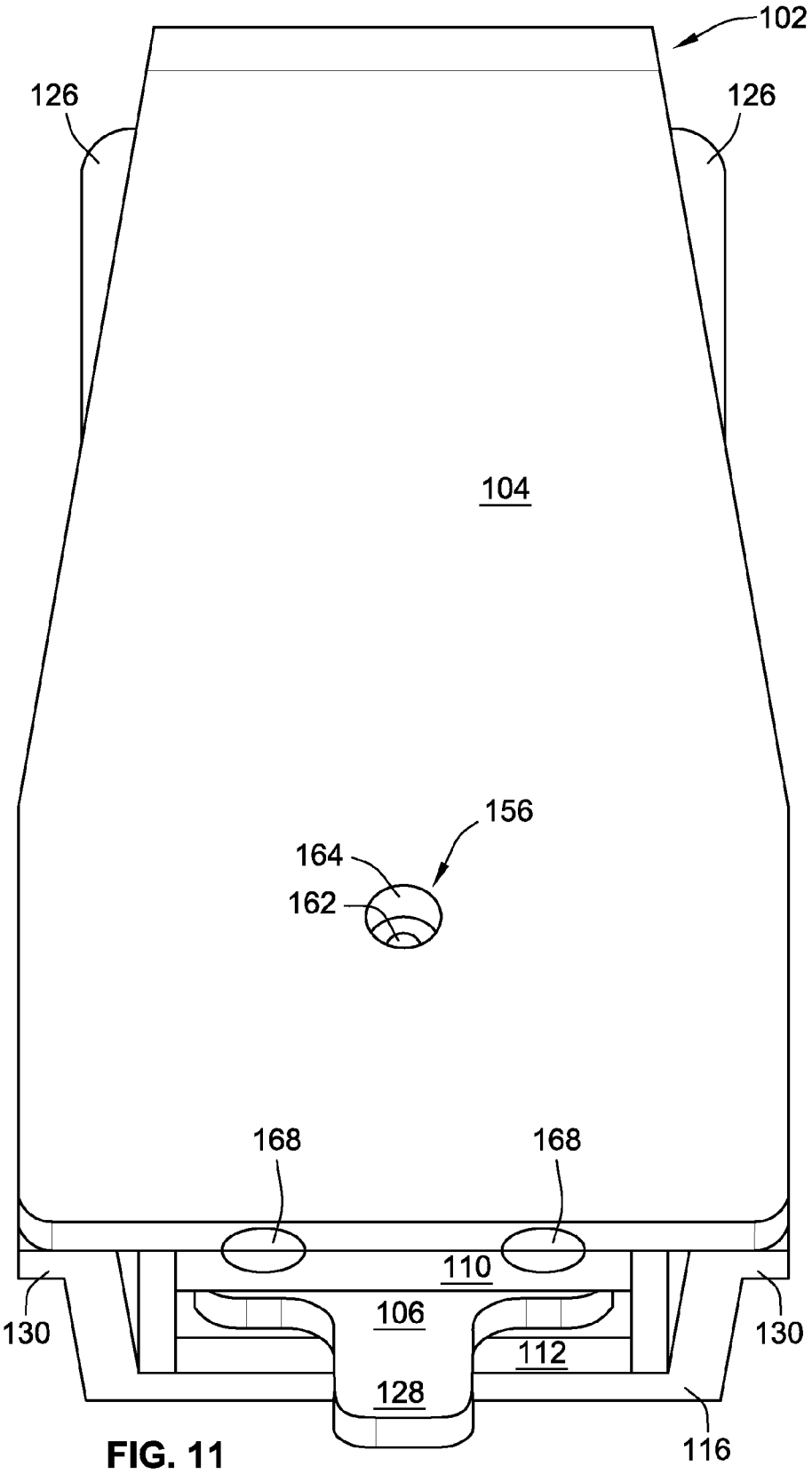

FIGS. 9-11 disclose a method of laser welding first upper magnet 110 to a first U-shaped element 102 of a transducer assembly 100 according to the first aspect of the invention. When carrying out the method, the following steps are carried out.

In FIGS. 9-10, no aperture is formed and, thus, the magnet 110 is provided on the first side 158 of U-shaped element 102. Then a laser beam is directed towards a welding zone of the second side of the U-shaped element 102 such that the material of the U-shaped element 102 melts in the area of the welding zone. The laser beam is directed towards the welding zone until not only the U-shaped element 102 has changed from a solid state to a melted stated in the area of the welding zone but also until a part of the magnet 110 also has melted. This part of the magnet 110 will be positioned in the area below that part of the U-shaped element 102 which has melted. When the magnet 110 and the U-shaped element 102 have cooled down, the melted areas are now welded together.

In FIG. 11 an aperture 156 is formed in the U-shaped element 102. The aperture 156 extends from a first side 158 of the U-shaped element 102 to a second side 160 of the U-shaped element 102. The aperture 156 may be formed by means of any conventional cutting method e.g. laser cutting or drilling. This may be done from the first side 158 and/or from the second side 160.

Next, the magnet 110 is provided on the first side 158 whereby a visible zone 162 of a surface of the magnet 110 is visible from the second side 160 of the U-shaped element 102 when viewing through the aperture 156 from said second side 160.

In a next step, an inner surface 164 of the aperture 156 and the visible zone 162 of the magnet are subjected to a laser beam which is directed towards the visible zone 162 and the inner surface 164 from the second side 160. This causes the material of the visible zone 162 and the inner surface 164 to melt whereby the magnet 110 is welded to the U-shaped element 102 by means of welding 166.

Moreover, the magnet 110 may additionally be welded to the U-shaped element 102 by subjecting the end surfaces 168,170 of the magnet 110 and the U-shaped element 102, respectively, whereby weldings 168 are created.

FIG. 12-18 disclose alternative ways of aligning the first part 132 and the second part 134 of the first magnet housing.

In all the embodiments, the first magnet housing defines one or more sides at least one of which defines a first part 132 and a second part 134. The first part 132 is defined by the first secured leg portion and the second part 134 is defined in the same plane 172 as the first part 132.

Figure 12:
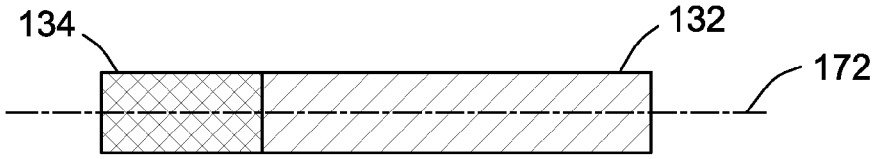
FIGS. 12-18 disclose different embodiments of "the same plane."
Figure 13:
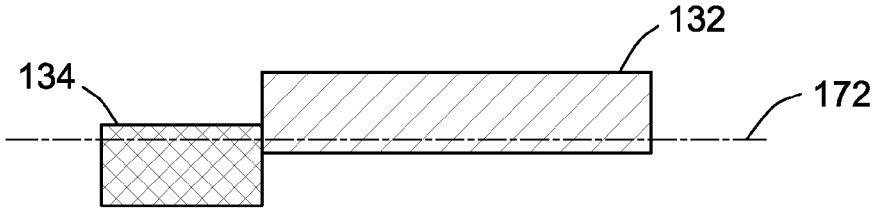
Figure 14:
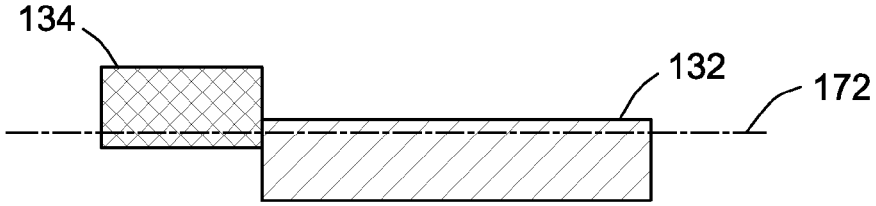

In the embodiment of FIGS. 12-14, "in the same plane" shall be understood such that the plane 172 shall extend through at least a part of the first part 132 and through at least a part of the second part 134.

Figure 15:
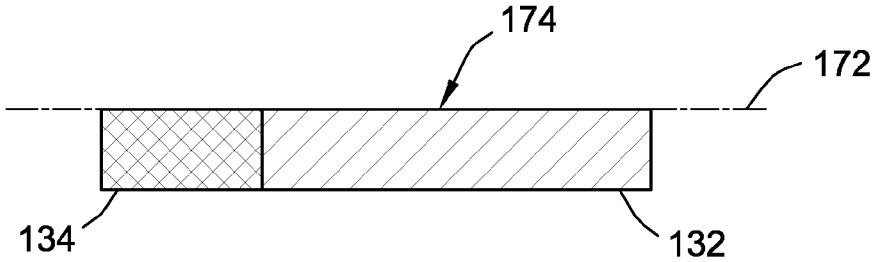

In the embodiment of FIG. 15, "in the same plane" shall be understood such that the outer surface 174 (i.e. the surface extending away from that part of the first movable leg portion which is provided inside the first magnet housing) of at least a part of (such as all of) the first part 132 and at least a part of (such as all of) the second part 134 coincide with said plane 172.

Figure 16:
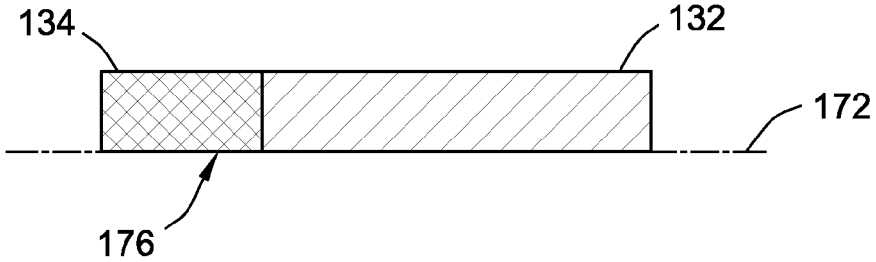

In the embodiment of FIG. 16, "in the same plane" shall be understood such that the inner surface 176 (i.e. the surface facing that part of the first movable leg portion which is provided inside the first magnet housing) of at least a part of (such as all of) the first part 132 and at least a part of (such as all of) the second part 134 coincide with said plane 172.

Figure 17:
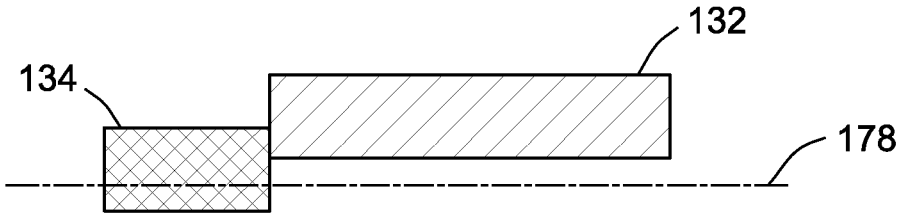

In the embodiment of FIG. 17, the first and the second parts 132,134 are arranged such that it is not possible to define a first plane 178 extending parallel to the general direction (the X-direction) of the first secured leg portion which extends through only one of the first and the second part 134. In other words, any such first plane 178 will extend through both the first part 132 and the second part 134 (this is illustrated in FIG. 18).

Figure 18:
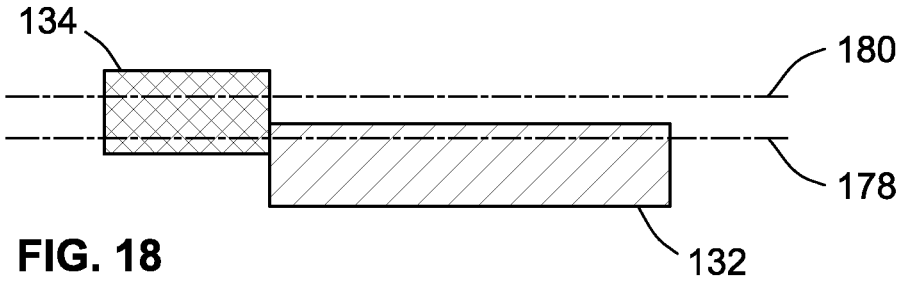

In the embodiment of FIG. 18, it is not be possible to define a second plane 180 which is parallel to the first plane 178 and which extends through a part of the first part 132 and/or the second part 134, through which the first plane 178 does not extend.

Each of these embodiments and obvious variations thereof is contemplated as falling within the spirit and scope of the claimed invention, which is set forth in the following claims.

What is claimed is:

1. A motor assembly for a transducer assembly for a hearing aid, the motor assembly comprising:

a magnet housing having an inner surface;

a U-shaped element having a secured leg portion which is secured to the magnet housing, and a movable leg portion which is adapted to be secured to a diaphragm of the transducer assembly;

a coil; and one or more magnets;

wherein the magnet housing encircles the one or more magnets and the movable leg portion in a plane having a normal which extends parallel to a general direction of the movable leg portion; and wherein at least a part of the magnet housing is defined by the secured leg portion and at least a part of the inner surface is defined by the secured leg portion.

2. The motor assembly according to claim 1, wherein the magnet housing defines one or more sides at least one of which defines a first part and a second part, the first part being defined by the secured leg portion and the second part being defined in the same plane as the first part.

3. The motor assembly according to claim 2, wherein the second part forms an extension of the first part in a plane defined by the secured leg portion.

4. The motor assembly according to claim 2, wherein a first and a second plane extend through the magnet housing, each of the planes defining a normal which extends in a direction parallel to the general direction of the movable leg portion, and wherein the first plane extends through both the first part and the second part of the magnet housing, while the second plane extends through the second part only.

5. The motor assembly according to claim 2, wherein the first part defines an indentation adapted to receive at least a part of the second part.

6. The motor assembly according to claim 2, wherein the second part defines an indentation adapted to receive at least a part of the first part.

7. The motor assembly according to claim 1, wherein the magnet housing is a single layer structure when seen in a radial direction from a centre of gravity of that part of the movable leg portion which is encircled by the magnet housing.

8. The motor assembly according to claim 1, wherein the one or more magnets comprise two magnets which are spaced apart so as to define a space in which the movable leg portion is provided.

9. The motor assembly according to claim 1, wherein each of the one or more magnets is attached to the magnet housing.

10. The motor assembly according to claim 1, wherein at least one of the one or more magnets is attached to the housing by one or more of: welding, soldering and an adhesive.

11. The motor assembly according to claim 1, wherein at least one of the one or more magnets is spaced apart from the magnet housing by a foil.

12. A transducer assembly for a hearing aid comprising:

a housing;

a first diaphragm which divides a first inner space of the housing into a primary part and a secondary part; and a first motor assembly having a U-shaped element including (i) a first secured leg portion and (ii) a first movable leg portion which is secured to the first diaphragm, the first motor assembly further comprising:

a coil;

one or more magnets; and a magnet housing element secured to the first secured leg portion of the U-shaped element, the magnet housing element and at least a part of the first secured leg forming a magnet housing having an inner surface at least a part of which is defined by the first secured leg portion;

wherein the magnet housing encircles the one or more magnets and the first movable leg portion in a plane having a normal which extends parallel to a general direction of the movable leg portion.

13. The transducer assembly according to claim 12, further comprising:

a second diaphragm which divides a second inner space of the housing into the secondary part and a tertiary part; and a second motor assembly having a second movable leg portion which is secured to the second diaphragm, the second motor assembly being similar to the first motor assembly.

14. The transducer assembly according to claim 12, wherein the magnet housing includes four sides, and wherein the magnet housing element is a C-shaped element substantially defining three sides of the magnet housing, and wherein the first secured leg portion substantially defines the fourth side.

15. The transducer assembly according to claim 12, wherein the magnet housing includes at least one side having a first part and a second part, the first part being at least a part of the first secured leg portion and the second part being defined in the same plane as the first part.

16. The transducer assembly according to claim 15, wherein at least a part of one of the first and second parts defines an indentation adapted to receive at least a part of the other of the first and second parts.

17. The transducer assembly according to claim 12, wherein the magnet housing forms a single layer structure when seen in a radial direction from a centre of gravity of a part of the movable leg portion encircled by the magnet housing.

18. A motor assembly for a transducer assembly, comprising: one or more magnets; a coil; a U-shaped element having a secured leg portion and a movable leg portion adapted to be secured to a diaphragm of the transducer assembly; and a C-shaped magnet housing element secured to the secured leg portion of the U-shaped element, the C-shaped magnet housing element and a portion of the secured leg portion forming at least a part of a magnet housing that encircles the one or more magnets and the movable leg portion of the U-shaped element, the C-shaped magnet housing element and the U-shaped element having inner surfaces facing the one or more magnets.

19. The motor assembly according to claim 18, wherein the magnet housing includes four sides, the C-shaped magnet housing element substantially defining three sides of the magnet housing, and wherein the first secured leg portion substantially defines a fourth side of the magnet housing.

20. The motor assembly according to claim 18, wherein the one or more magnets includes two magnets that are spaced apart to define a space in which the movable leg portion is positioned, the one or more magnets being attached to the magnet housing.

* * * * *